United States Patent [19]

Aho

[11] 4,416,036

[45] Nov. 22, 1983

[54] FASTENING MEANS FOR THE WRIST STRAP OF A SKI STICK AND METHOD FOR THE MANUFACTURE THEREOF

[75] Inventor: Yrjö Aho, Espoo, Finland

[73] Assignee: Exel Oy, Helsinki, Finland

[21] Appl. No.: 347,323

[22] Filed: Feb. 9, 1982

[30] Foreign Application Priority Data

Feb. 16, 1981 [FI] Finland ..... 810471

[51] Int. Cl.[3] ..... A63C 11/22

[52] U.S. Cl. ..... 24/136 R; 280/821

[58] Field of Search ..... 24/136 R, 136 K, 115 K, 24/115 M, 115 H; 280/821 R, 822

[56] References Cited

U.S. PATENT DOCUMENTS

| | | | |
|---|---|---|---|
| 3,560,014 | 2/1971 | Bruckl | 280/821 |
| 4,288,100 | 9/1981 | Aho | 280/821 |
| 4,288,101 | 9/1981 | Aho | 280/821 |

FOREIGN PATENT DOCUMENTS

| | | | |
|---|---|---|---|
| 2267130 | 11/1975 | France | 280/821 |
| 919589 | 2/1963 | United Kingdom | 280/821 |

*Primary Examiner*—Robert P. Swiatek
*Assistant Examiner*—David I. Tarnoff
*Attorney, Agent, or Firm*—Morgan, Finnegan, Pine, Foley and Lee

[57] ABSTRACT

Fastening means for the wrist strap of a ski stick, said means being positioned in a cavity (3) of the knob (2) of a stick handle (1). The fastening means is a removable unit separable from the stick knob and consisting of two plastic elements (5) and (7), between which said wrist strap (4) can be anchored as desired. The plastic elements are discrete elements within which the opposite ends of wrist strap (4) are embedded by molding. One (5) of the elements is anchored by profile locking (10, 11) in anchoring grooves (10) on the walls of cavity (3) in such a position that a wrist strap anchoring point (6) will be on the top face of said element. The other plastic element (7) is wedged into a downwards converging space between the wall of cavity (3) and the first plastic element (5) in such a position that another wrist strap anchoring point (8) will be on the lower face of the first element. The section of wrist strap (4) between plastic elements (5) and (7) is passed through between plastic elements (5) and (7). The abutting faces of plastic elements are jagged (15, 17). With said wrist strap (4) straightened out, said jagged faces (15, 17) of plastic elements (5, 7) face in the same direction. The fastening means is manufactured by passing a continuous strap material through the adjacent mold cavities of plastic elements (5, 7) and afterwards strap (4) is cut between plastic elements (5, 7).

3 Claims, 5 Drawing Figures

FASTENING MEANS FOR THE WRIST STRAP OF A SKI STICK AND METHOD FOR THE MANUFACTURE THEREOF

This invention relates to a fastening means for the wrist strap of a ski stick, said means being positioned in the cavity of the knob of a ski stick handle as a unit that is separate and removable from the stick knob and consists of the elements, between which the wrist strap can be locked as desired. The invention also relates to a method for the manufacture of such a fastening means.

A wrist strap fastening means of the above type is disclosed in the applicants' earlier U.S. Pat. No. 4,288,100. In this prior art solution, the removable unit comprises a buckle which consists of a body member and a lever pivotably hinged thereto. The wrist strap is passed between the body and the lever and, thus, with the lever turned open, the length of said wrist strap can be adjusted and, when the lever is closed, the wrist strap is locked to the adjusted length. This solution has proved successful particularly for the reason that the buckle which forms said removable unit can be made of separate plastics material that is harder than the knob, whereby anchoring of the wrist strap can be effected by moulding and embedding in plastics material.

The object of the present invention is to further develop said fastening means to make it even more simple to manufacture and easier and quicker to assemble without impairing its ready adjustability and reliable grip.

In order to achieve this object, the fastening means for the wrist strap of a ski stick is characterized in that said unit consists of two separate plastic elements in which the opposite ends of said wrist strap are ambedded by moulding, and that one of the plastic elements is anchored by profile locking in the anchoring grooves on the walls of a cavity, the position of the element being such that one anchoring point of said wrist strap is on the top surface of the element, and the other plastic element is wedged into a downwardly converging space between the cavity and the first plastic element in such a position that the other anchoring point of said wrist strap is on the lower surface, whereby the portion of said wrist strap between the plastic elements is passed through between said plastic elements.

In order to further simplify and expedite the assembly work, a preferred embodiment is characterized in that the wall of said cavity is provided with a slit extending from an aperture for a wrist strap to the upper edge of the wall. Thus, the wrist strap need not be threaded through like "a yarn through the eye of a needle", but it can be pulled into position through said slit.

The following is a more detailed description of one embodiment of the invention with reference made to the accompanying drawings, in which.

Figure 1:
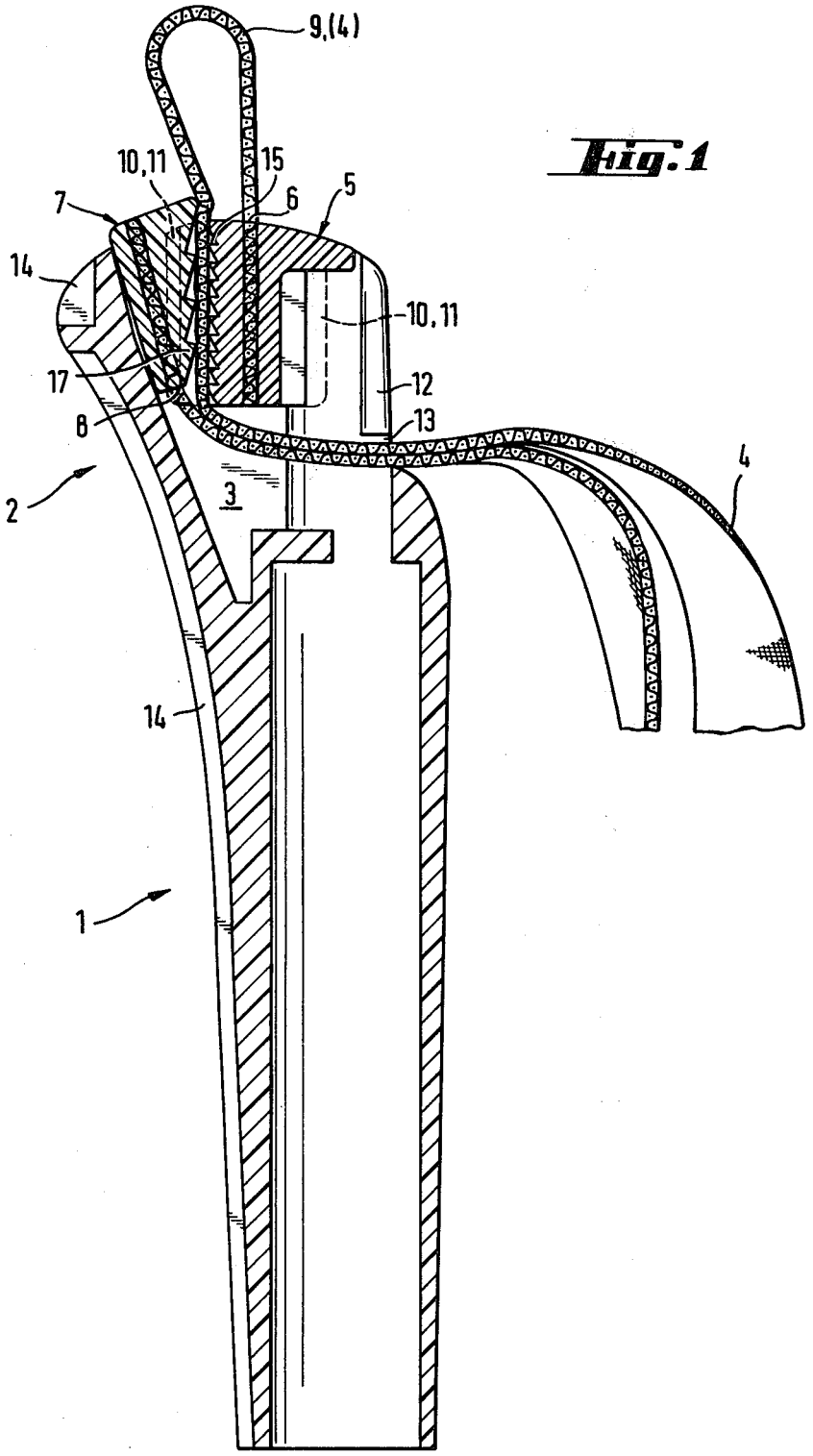
FIG. 1 is a vertical section of the handle of a ski stick, a wrist strap fastening means according to the invention being positioned in a cavity in the knob-shaped top section of said handle.
Figure 2:
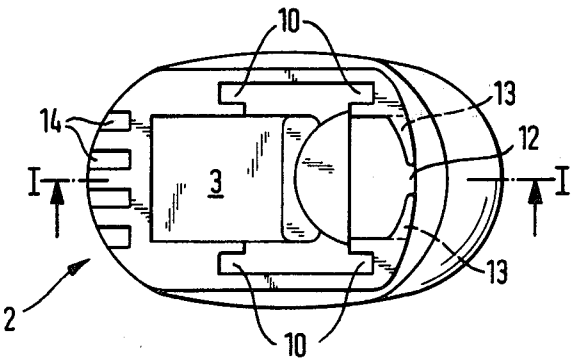
FIG. 2 is a plan view of the knob-shaped top section of the handle without fastening means.
Figure 5:
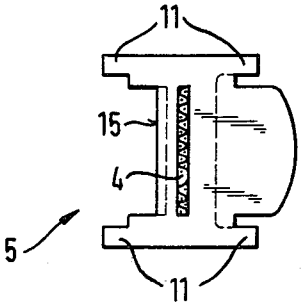
FIG. 5 shows the other plastic element of the fastening means viewed from the end facing upwards.

Referring to FIG. 1, the knob-shaped top section 2 of a ski stick handle 1 is provided with a cavity 3. A wrist strap 4 runs out of said cavity 3 through an aperture 13 in its wall.

The opposite ends of the wrist strap 4 are anchored by embedding and moulding in plastic elements 5 and 7 during their manufacture.

The walls of cavity 3 are provided with vertical anchoring grooves 10 into which the locking flanges 11 of said plastic element 5 can be inserted. This way the plastic element 5 is profile-locked in position and can only be unlocked by pulling upwards. The plastic element 5 is positioned so that the fastening point 6 of the wrist strap will face upwards, said wrist strap making a loop 9 above the knob. The other plastic element 7 is wedged into a downwards converging space between the wall of cavity 3 and the plastic element 5, so that the fastening point 8 of said wrist strap faces downwards. The portion of said wrist strap 4 between plastic elements 5 and 7 is passed between said plastic elements 5 and 7, so when a pulling force is applied to plastic element 7, the wrist strap is tightened and fixed between said plastic elements 5 and 7. If it is desired to release the locking and adjust the length of the wrist strap, the loop 9 is pulled e.g. by prying with the point section of the other stick, whereby plastic element 7 slides upwards and the wrist strap can be displaced between the plastic elements. Re-locking is effected merely by tightening the wrist strap 4 wound around the hand. In order to prevent the sliding of wrist strap 4, the abutting faces of plastic elements 5 and 7 are provided with jags 15 and 17. It should be noted that for proper running of the wrist strap 4, the latter is secured to plastic elements 5 and 7 so that, with the wrist strap straightened out (FIGS. 3 and 4), the jagged faces 15 and 17 of the plastic elements face in the same direction.

In order to eliminate threading of the wrist strap 4 through aperture 13, the wall of cavity 3 is provided with a through-going slit 12 between aperture 13 and the wall upper edge. Thus, the wrist strap 4 can be threaded into position in aperture 13 through slit 12.

To make the wall of cavity 3 withstand the wedging action of plastic element 7 and to avoid excessive thickness thereof, said wall is provided with vertical grooves 14. At the same time, this set of vertical grooves is made to cover the height of the entire handle 1 to further contribute to reliable handgrip.

It should be appreciated that the fastening means of the invention with its plastic elements 5 and 7 and wrist strap 4 comprises a single component which is positioned in cavity 3. Thus, there are no components that could be lost or require manual joining.

Figure 3:
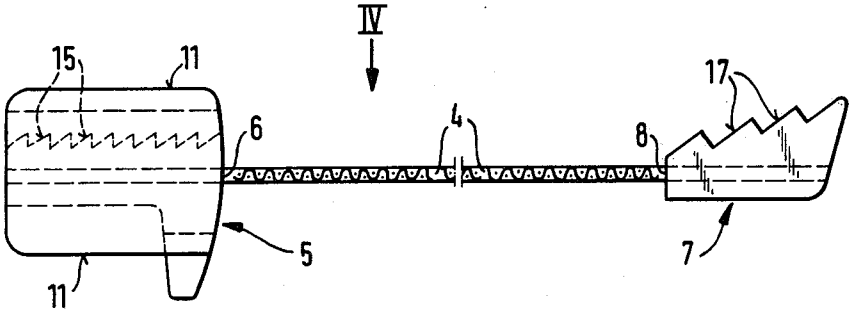
FIG. 3 is a side view of a fastening means removed from its position.
Figure 4:
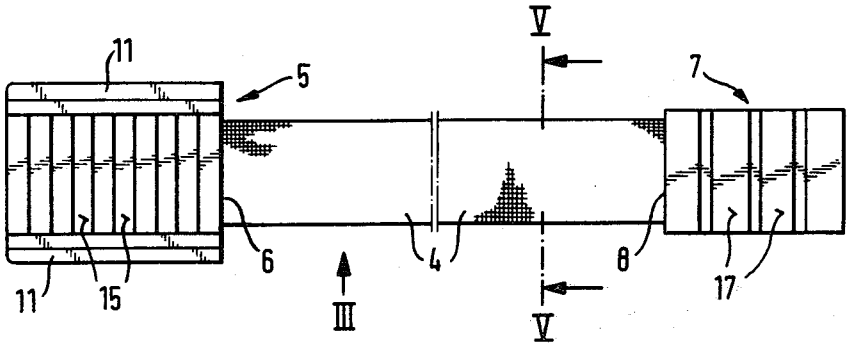
FIG. 4 shows the same in plan view.

A method of moulding the ends of wrist strap 4 within plastic elements 5 and 7 can be further developed to be quicker and more reliable than the prior art methods, in which the cut-off end of a strap is placed in a mould cavity and plastics is injection moulded therearound. Insertion of the strap end into a mould cavity takes time, and carelessness on the part of a person who does the work results in an unreliable joint. In the method of the present invention the solution is to manufacture a continuous strap on which there are side by side anchored pairs of elements 5 and 7 spaced by a narrow strap portion, so element 5, as seen at the left-hand end of the strap in FIG. 3, is by its left-hand face nearly in engagement with the right-hand face of element 7 shown at the right-hand end of the strap. The elements are separated by cutting the connecting narrow strap section. The cutting operation need not be effected by means of hot cutting for preventing inconvenient unweaving, since both ends of the cut-off strap length terminate in a plastic element which effectively stops unweaving as such. Thus, it is possible to employ simple group cutting.

Thus, in the present method, the mould cavities for both elements lie immediately adjacent to each other separated by a narrow strip and, prior to the moulding step, the strap material has been pulled through both cavities. When cutting is effected afterwards, it can be reliably verified that the entire length of the strap has in fact been in the mould cavities during moulding.

I claim:

1. A ski stick handle including fastening means for forming a wrist strap loop thereto, said fastening means being positioned in a cavity (3) in a knob-shaped member (2) of said stick handle (1) as a removable unit separable from said knob-shaped member, said unit comprising two discrete plastic elements (5,7) between which a wrist strap (4) can be locked as desired, characterized in that said two discrete plastic elements (5,7) have embedded therein the opposite ends of said wrists strap (4) and that one (5) of said plastic elements is anchored by profile locking (10,11) in anchoring grooves (10) on interior walls of said cavity (3) in such a position that the junction (6) of said wrist strap and said one plastic element (4) is on the top face of said one plastic element (5), and the other of said plastic elements (7) is wedged into a downwardly converging space between said interior cavity wall (3) and said one plastic element (5) in such a position that the junction (8) of said wrist strap and said other plastic element is on the lower face of said other plastic element, the portion of said wrist strap (4) between said plastic elements (5,7) being passed between said plastic elements (5,7) and through an aperture opening (13) in the sidewall of said knob-shaped member (2) thereby forming a loop.

2. A ski stick handle according to claim 1 wherein the side wall of said cavity (3) is provided with a slit (12) which extends from said aperture opening (13) to the upper edge of said side wall.

3. A ski stick handle according to claim 1 characterized in that abutting faces of said plastic elements are jagged (15,17) and said wrist strap (4) is anchored to said plastic elements (5,7) in such a manner that, when said wrist strap (4) is straightened out, the jagged faces of said plastic elements (5,7) face in the same direction.

* * * * *